US005317115A

United States Patent [19]

Forsberg

[11] Patent Number: 5,317,115

[45] Date of Patent: May 31, 1994

[54] ELECTRONIC CONTROL FOR A MICROWAVE OVEN

[75] Inventor: Sven T. Forsberg, Norrköping, Sweden

[73] Assignee: Whirlpool Europe B.V., Veldhoven, Netherlands

[21] Appl. No.: 993,321

[22] Filed: Dec. 18, 1992

[30] Foreign Application Priority Data

Dec. 23, 1991 [SE] Sweden ..... 9103834

[51] Int. Cl.[5] ..... H05B 6/68

[52] U.S. Cl. ..... 219/716; 219/721

[58] Field of Search ..... 219/10.55 B, 10.55 C; 99/325

[56] References Cited

U.S. PATENT DOCUMENTS

| | | | |
|---|---|---|---|
| 3,999,027 | 12/1976 | Moore | 219/10.55 B |
| 4,011,428 | 3/1977 | Fosnough et al. | 219/10.55 B |
| 4,506,127 | 3/1985 | Satoh | 219/10.55 B |
| 4,628,439 | 12/1986 | Fowler et al. | 219/10.55 B |

*Primary Examiner*—Philip H. Leung

*Attorney, Agent, or Firm*—Robert O. Rice; Stephen D. Krefman; Thomas J. Roth

[57] ABSTRACT

A microwave oven having microwave source and a power unit associated therewith which is supplied with mains voltage via a relay. A microprocessor device comprised in the oven is used for controlling switch-on and switch-off of the relay, eliminating thereby the influence by varying switch-on/switch-off times of the one and same relay and between different relays, and allowing for a connection and respectively disconnection of the mains voltage at a desirable phase thereof.

6 Claims, 5 Drawing Sheets

ELECTRONIC CONTROL FOR A MICROWAVE OVEN

BACKGROUND OF THE INVENTION

This invention is directed to a microwave oven comprising a microwave source and a power unit including a high voltage transformer for supplying high voltage to said microwave source, said high voltage transformer being supplied with mains voltage via a switch device and its associated control unit in order to connect the mains voltage, when starting the oven, at a moment substantially coinciding with a mains voltage maximum.

In a microwave oven it is a requirement that the high voltage transformer shall be connected to the mains voltage at a desirable phase, coinciding with a voltage maximum of the mains voltage. By establishing the connection in this phase the connection current will be as low as possible and a strong current pulse on the mains is avoided, this being a requirement in several countries in order to allow a connection of the microwave oven to the mains. By connecting in this manner the sound effect otherwise appearing as a consequence of a strong connection current through the high voltage transformer is suppressed. Practically, this requirement means that the connection to the mains shall take place within a limited time interval around the mains voltage maximum.

In prior art microwave ovens a so called triac is used for this connection. The use of a triac has a number of drawbacks. A triac is sensitive to interferences, which may have the consequence that the connection takes place at a moment which differs from the desirable phase. A triac has a high heat dissipation at the power levels in question, meaning in turn a requirement of special cooling. The cooling is normally obtained by means of cooling plates, which must be relatively large and consequently space demanding. A further drawback is that the triac needs a special current supply in order to provide isolation between the power current part and the control system of the oven, this being a safety requirement in several countries. This may be obtained by the use of a so called opto-triac, an auxiliary winding of the transformer or a corresponding solution, meaning as a consequence increased complexity and increased costs.

SUMMARY OF THE INVENTION

The object of the invention is to allow for the mains connection of the high voltage transformer as described above by the use of a switch device not having the drawbacks of prior art technology.

The object of invention is obtained by a microwave oven of the type mentioned in the background in which a switch device comprises a relay being supplied at switch-on with a control voltage from a control unit and the relay contacts of which are closed at switch-on with a delay corresponding to the switch-on time of the relay, feedback means that are arranged in order to supply to the control unit a feedback signal which signals changing states when the relay contacts change from an open to a closed position, a reference signal indicating the mains voltage phase also being supplied to the control unit, the control unit being a microprocessor device programmed to perform the following during switch-on of the relay:

assume a value $t_{dc}$ for the relay switch-on time calculate the moment $T_{on}$ of a mains voltage maximum from the reference signal switch on the relay by supplying the control voltage at the moment $T_{on}-t_{dc}$ sense the feedback signal within an interval around $T_{on}$ when the relay contacts are closed within said interval, maintain the relay switched on alternatively, when the relay contacts are open within said interval, perform relay switch-off by interrupting the control voltage supply, assume a new value of $t_{dc}$ and repeating the programmed steps until the relay contacts are closed within the interval.

The problem with relays for the applications in question is that each separate relay has a switch-on time, that is the time between the moment when the control voltage is supplied to the relay and the moment when the relay contacts are closed, and that this switch-on time varies from relay to relay. This means that a relay will normally not be useful for mass-manufactured products such as the microwave oven in question, in which switching or switch-on must take place with great accuracy of time. Obtaining the desirable accuracy would require a special trimming of the relay of each individual oven. Furthermore, the switch-on time will be influenced by variations of the control voltage to the relay and the ambient temperature. These limitations of the relay are compensated for by the invention and at the same time a relay does not generally show the above mentioned drawbacks of the prior art triac embodiment. The use of a relay is furthermore advantageous with respect to costs and space.

A relay has a switch-off time from the interruption of the control current supply to the opening of the relay contacts, giving a corresponding delay when the oven is stopped. The influence of the switch-off time is eliminated by an embodiment of the invention, which is characterized in that said microprocessor device is programmed to perform the following steps at a relay switch-off:

assume the value $t_{do}$ for the switch-off time calculate $T_{off}$ of a zero transition of the mains voltage switch off the relay by interrupting the supply of control voltage at the moment $T_{off}-t_{do}$ sensing the feedback signal within an interval around $T_{off}$ when the relay contacts are opened within the interval, maintain the switch-off time alternatively, when the relay contacts are not opened within the interval, assuming a new value $t_{do}$ repeating the programmed steps during future switch-offs until the relay contacts are opened within the interval.

By these features of the invention the problem of varying switch-off times of different relays are eliminated and thereby also a switch-off of the mains voltage at a desirable moment is made possible. The switch-off of the mains voltage shall take place when the current through the relay is as low as possible, coinciding substantially with a zero transition of the mains voltage. By opening the relay contacts at a zero transition of the mains voltage the generation of sparks between the relay contacts is minimized extending thereby the lifetime of the contacts.

In microwave ovens a signal is necessary which indicates an open or closed state of the oven door of the microwave oven which is transmitted to the control system of the oven. In ovens having electrical isolation between the control system and the power current part of the oven, meaning usually the use of an opto-triac in the prior art embodiment which uses a triac for the control of the mains voltage connection normally a door switch is used in order to generate door status information. A signal is generated which changes when the door is moved from an open to a closed position and the reverse. This signal is fed back to the control system by means of a defined feedback line. This defined feedback is necessary because the prior art triac embodiment does not provide a feedback of information from the triac to the control system. The feedback of door status information is preferably obtained by a further embodiment of the microwave oven according to the present invention, in which the control system of the oven is electrically isolated from the power current part of the oven. In this aspect, the door switch is operable so as to interrupt, and respectively, close the mains voltage when the door is open and respectively closed, and in which said feedback means are arranged to supply to the control system door status information indicating an open or closed position of the door. The feedback means comprises an opto-coupler, being arranged to be conductive during one-half period of the mains voltage when said relay contacts are open and the oven door is closed, and further, when the relay contacts are closed and the oven door is closed, change to a conductive state during the second half period of the mains voltage, and to a non-conductive state when the oven door is opened, the feed-back signal from the opto-coupler supplying thereby information about both the position of the relay contacts and door status. By this embodiment the need of a special door switch and its associated feedback line and connection means are eliminated.

Figure 1:
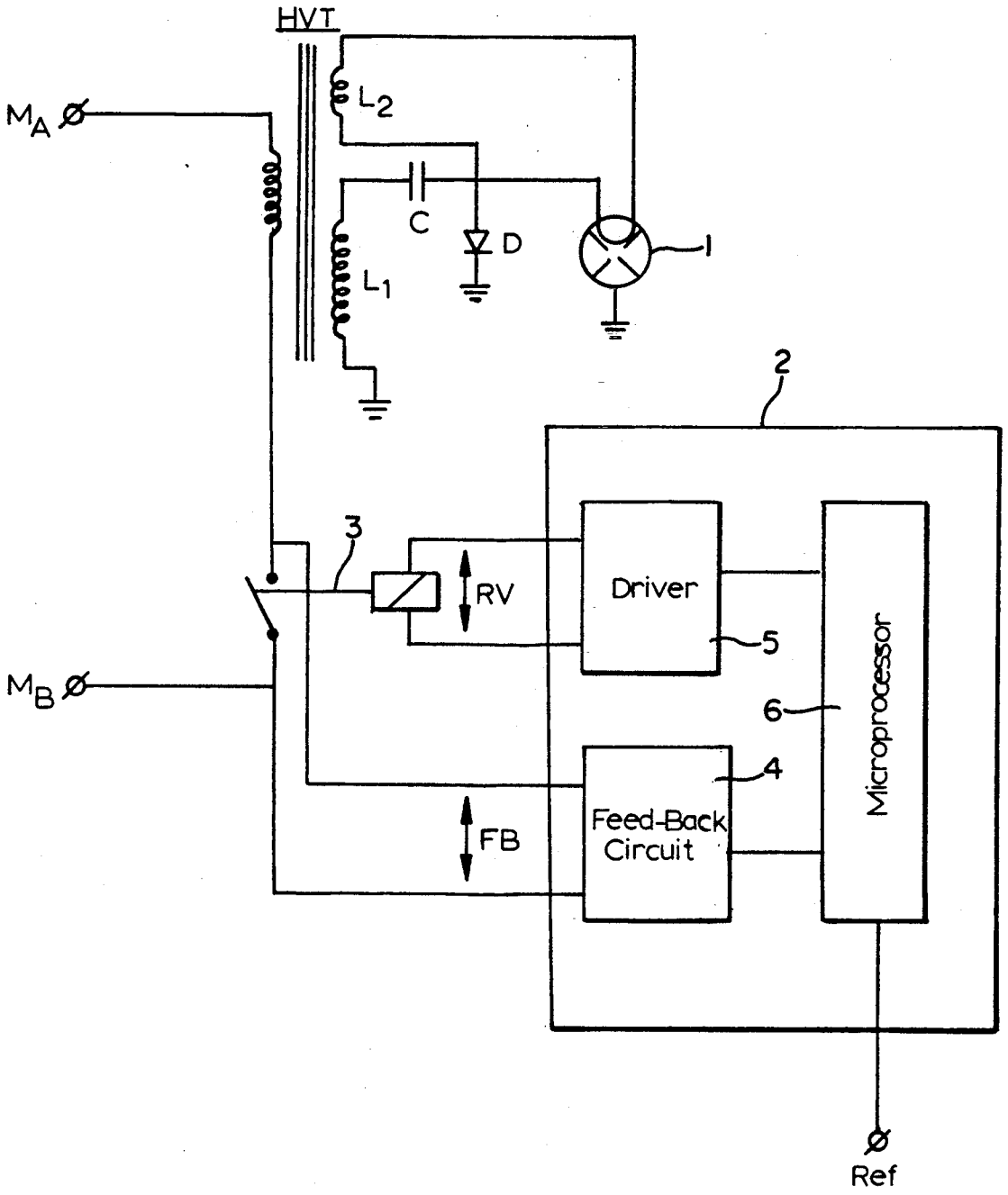
FIG. 1 shows a main circuit of the microwave oven, including the power unit, the microwave source, the switch device for connecting the mains voltage and the control unit of said switch device.
Figure 4:
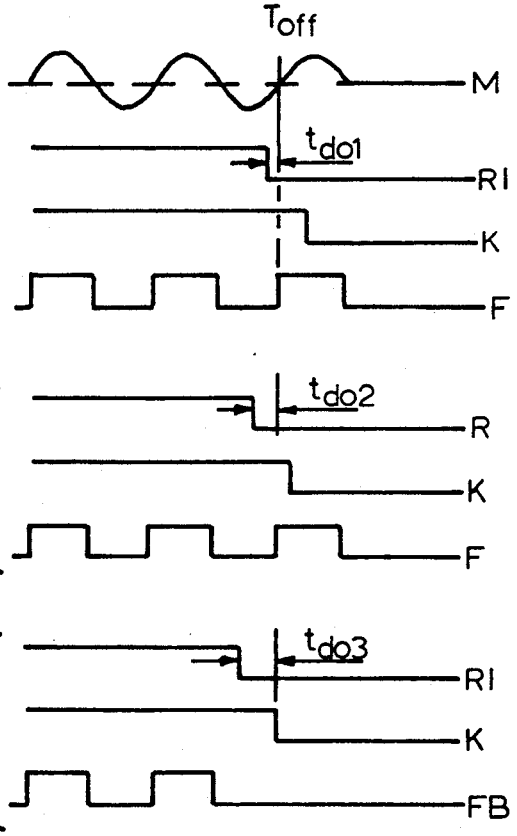
Figure 3:
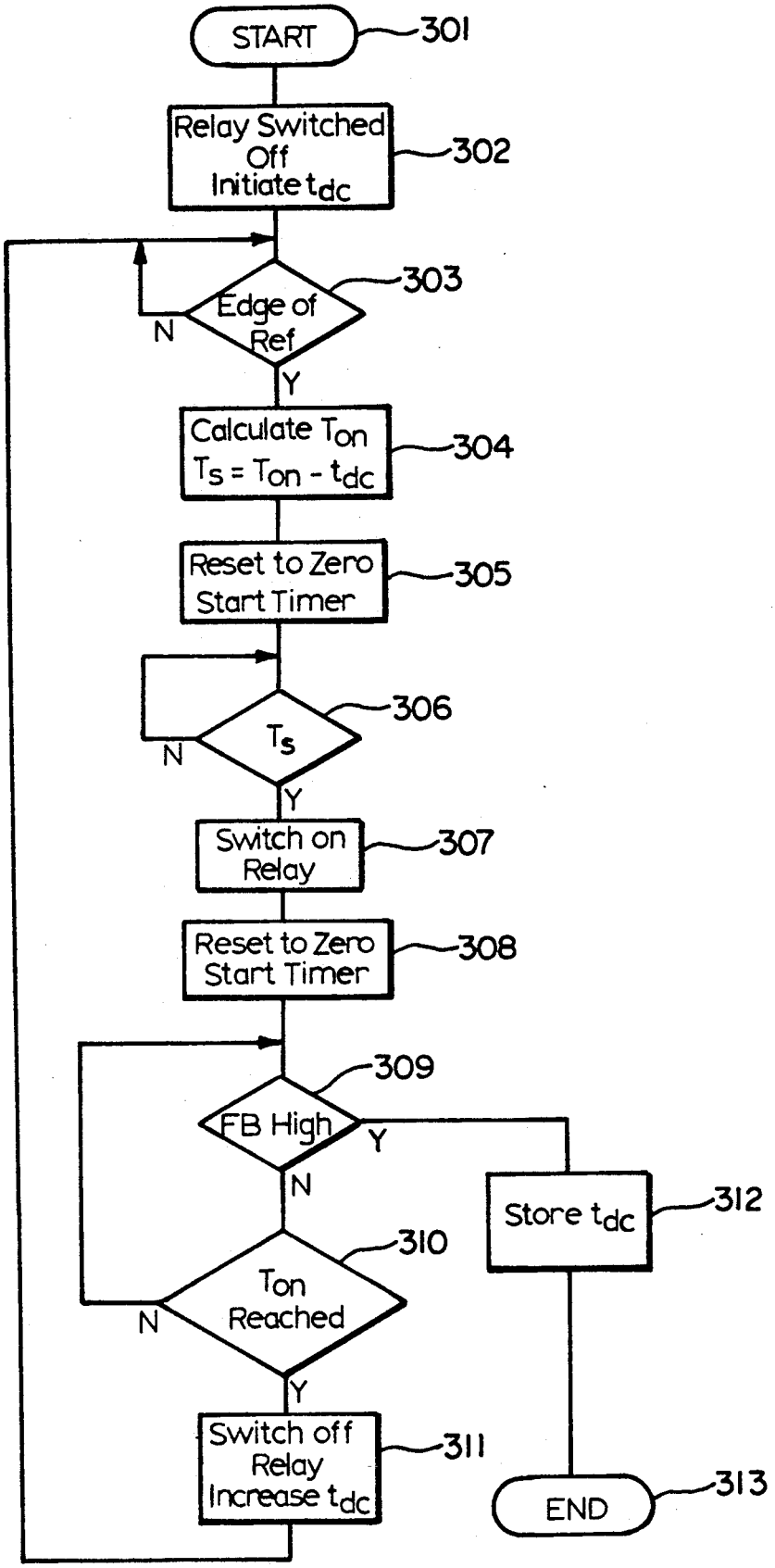
Figure 5:
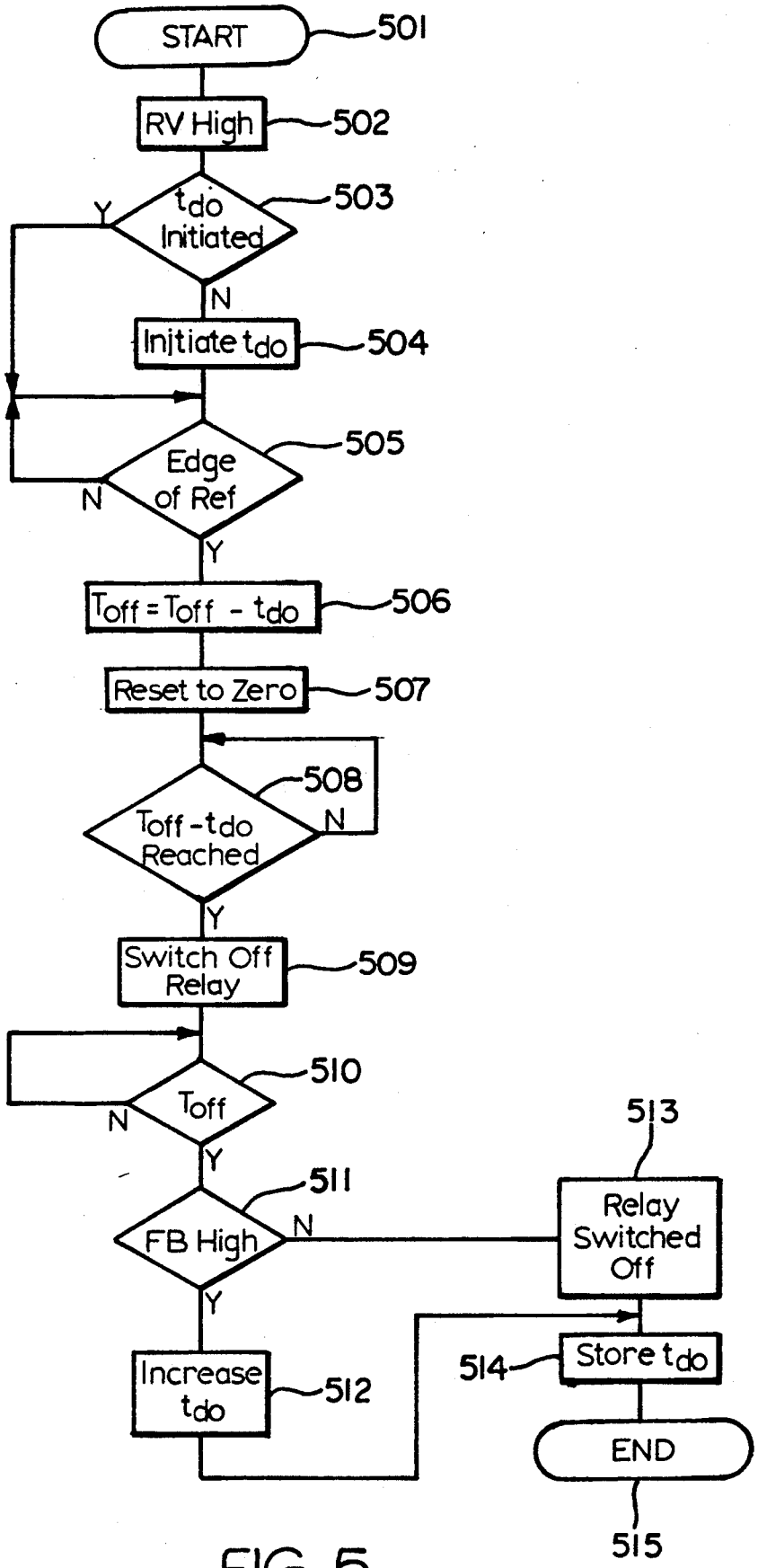
Figure 6:
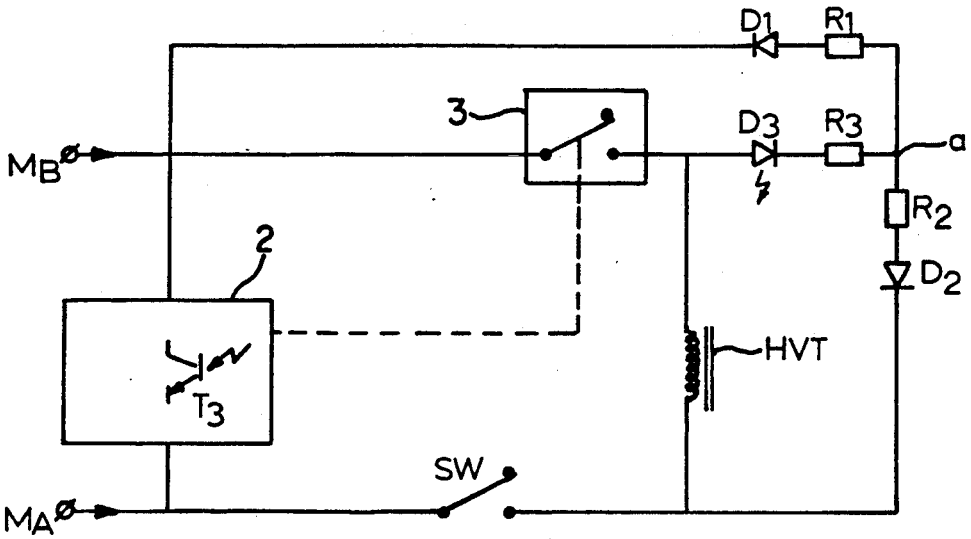
Figure 7:
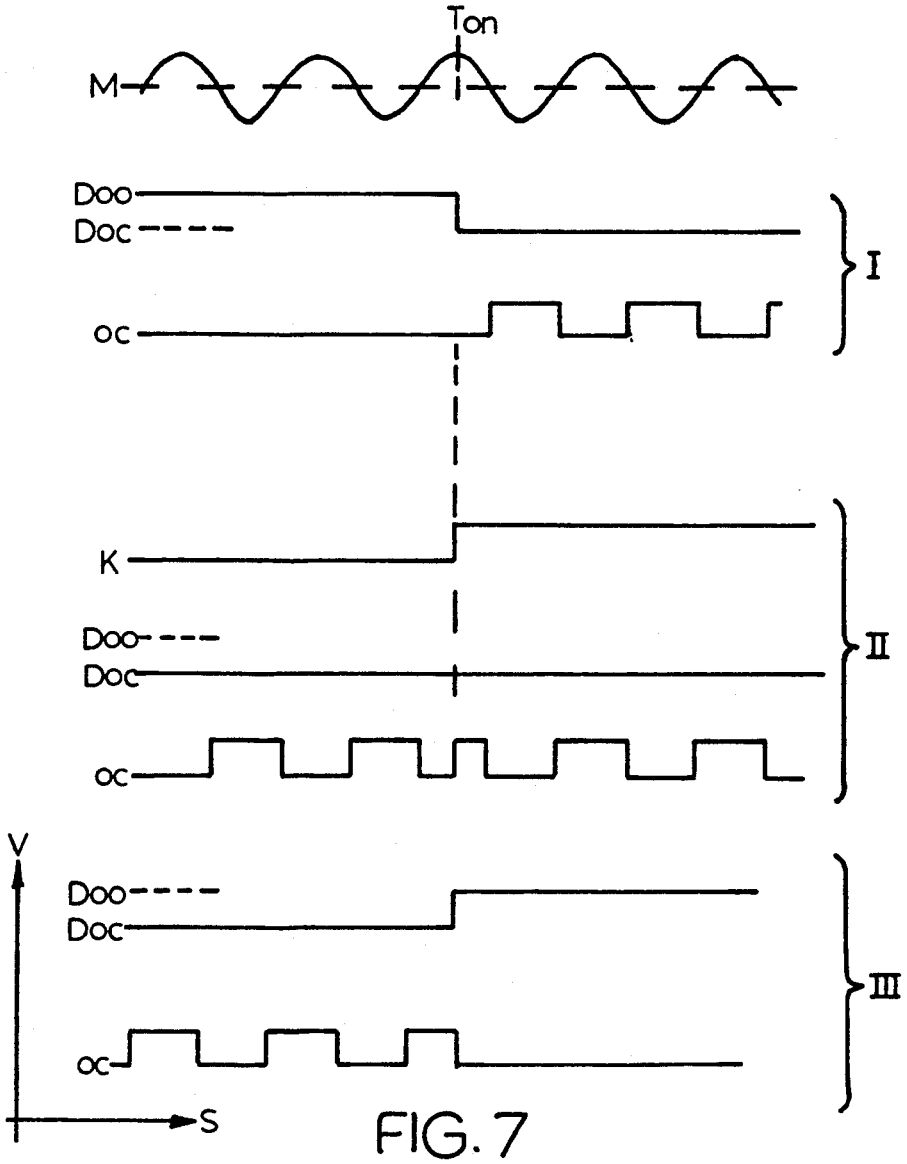

FIGS. *2a, 2b* disclose graphic diagrams illustrating the control of the switch-on moment of the switch device relay;

FIG. 3 shows a flow chart on the microprocessor program steps when the relay is switched on;

FIG. 4 shows a graphic diagram illustrating the control of the relay switch-off moment;

FIG. 5 shows a flow chart on the program steps performed by the microprocessor device when the relay is switched off;

FIG. 6 shows a modified embodiment of the circuit diagram of FIG. 1, in which the feedback means comprises an opto-coupler, and in which a door switch is included in one of the high voltage transformer mains connections;

FIG. 7 shows a graphic diagram illustrating the operation of the feedback disclosed in FIG. 6.

DESCRIPTION OF THE PREFERRED EMBODIMENT

The main circuit diagram as shown in FIG. 1 illustrates the parts of the microwave oven involving the. FIG. 1 discloses the power unit including the high voltage transformer HVT, which is connected to the mains voltage via the terminals $M_A$ and $M_B$. The microwave source, that is the magnetron 1, is supplied from the high voltage transformer with a rectified high voltage via the coil $L_1$ and a rectifier circuit illustrated by the capacitator C and the diode D. A filament current is supplied to the hot cathode of the magnetron 1 via the transformer coil L2.

FIG. 1 further shows the switch device comprising the relay 3, and the control unit 2 for controlling the relay 3.

The control unit 2 comprises a feedback circuit 4, supplying feedback information about the position of the relay contacts of the relay 3, that is if the relay contacts are open or closed. Via the feedback circuit 4 this information is supplied to the microprocessor device 6. Also a reference signal Ref (see FIG. *2a*) is supplied to the microprocessor device, said reference signal being formed by a square wave pulse train of mains voltage frequency of the same phase as the mains voltage, or having a defined phase shift in relation thereto. As shown in FIG. *2a* Ref changes from a low to a high level at the positive zero transitions of the mains voltage, and from a high to low level at the negative zero transitions of the mains voltage. The microprocessor device 6 controls the relay 3 via a driver 5. The feedback circuit 4 as well as the driver 5 are of a type which is well known to the person of ordinary skill in the art.

The feedback circuit 4 is supplied with the feedback signal FB, changing state from a low to a high level when the relay contacts change from open to closed position. The driver 5 generates the control voltage RV to the relay 3 and has a high level when the relay is switched on and a low level when the relay is switched off. In the condition disclosed in FIG. 1 the relay control voltage RV is low and consequently the relay contacts are open, meaning that the mains voltage via terminals $M_A$ and $M_B$ to the high voltage transformer HVT is interrupted.

In FIG. *2a* and *2b* are disclosed graphic diagrams illustrating the progress of the control of the switch-on moment of the relay 3 in FIG. 1. FIG. *2a* shows four time intervals of the mains voltage M, and the corresponding time intervals of the reference signal Ref, the relay control voltage RV and the feedback signal FB. Each of the four time intervals represents a selected switch-on moment of the relay related to the moment of a voltage maximum of the mains voltage. A voltage maximum appears at the moment $T_{on}$, which is calculated by the microprocessor device based on the reference voltage Ref.

In the first case a first value of the relay switch-on time $t_{dc}$ is assumed. The relay is switched on by supplying the control voltage RV at the moment $T_{s1}$, appearing the assumed switch-on time before $T_{on}$. Simultaneously, the feedback signal FB is sensed at the moment $T_{on}$. In this case FB is low at moment $T_{on}$, meaning that the relay contacts have not yet reached a closed state, and therefore the supply of control voltage RV is interrupted at the moment $T_{on}$. The same progress is repeated during the two following time intervals, when the relay is supplied with a control voltage at the moments $T_{s2}$ and respectively, $T_{s3}$, appearing longer switch-on times before voltage maximum of the mains voltage. Also in these two cases the relay contacts have not yet reached a closed state and therefore the control voltage supply is interrupted at the moment $T_{on}$.

In the fourth case the relay is supplied with the control voltage RV at the moment $T_{s4}$, appearing the switch-on time $t_{dc}$ before the moment $T_{on}$ of a voltage maximum of the mains voltage. When $T_{on}$ appears the feedback signal FB has changed from a low to a high level. From this follows that the relay contacts have reached a closed state and therefore the relay is maintained in the switch-on position by maintaining a high level of the control voltage RV.

Figure 2A:
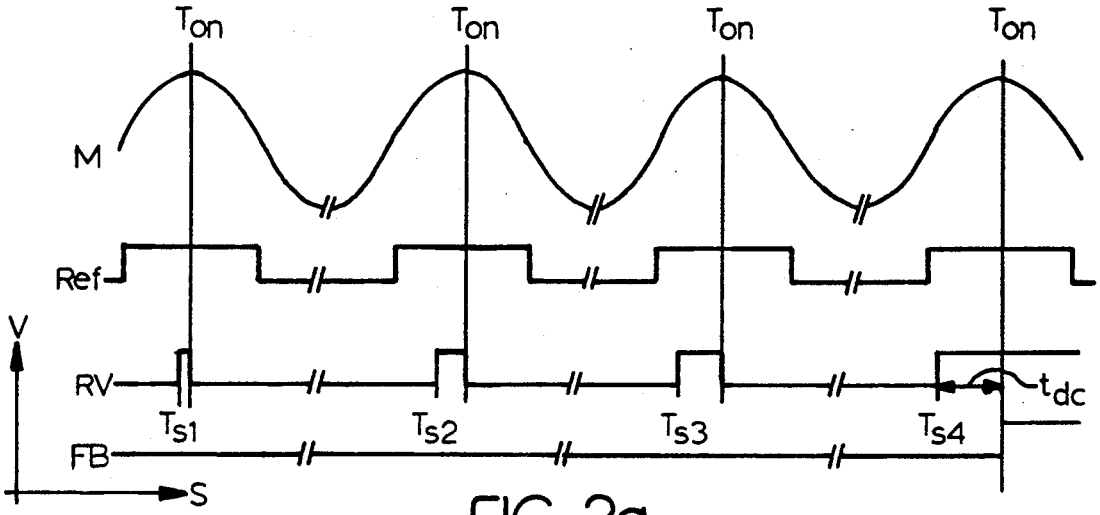
Figure 2B:
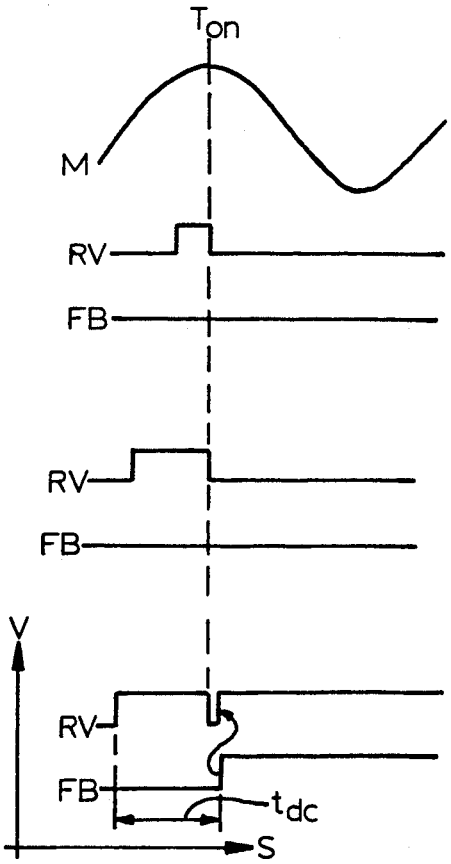

In practice, the sensing of the feedback signal FB takes place within a short time interval around $T_{on}$. This is caused by the fact that the relay contacts may be closed after interruption of the control voltage due to the inertia of the relay. This is illustrated by the three switch-on cases which are disclosed in FIG. 2*b*. The different cases have been denoted I, II, III. In FIG. 2*a*, M represents the mains voltage, RV represents the control voltage to the relay and FB represents the feedback signal. In cases I and II the assumed value of the switch-on time has been too short, meaning the relay contacts have not yet reached closed state at the moment $T_{on}$, and consequently that the control voltage is interrupted at that moment. In case III a value which is somewhat smaller than the real switch-on time $t_{dc}$ of the relay has been assumed. Consequently the relay contacts have not yet reached a closed state at the moment $T_{on}$ and therefore the control voltage RV is interrupted. Simultaneously the relay contacts have been accelerated and continue its closing movement also after interruption of the control voltage. Consequently the relay contacts are closed a short time after $T_{on}$ and then the feedback signal FB changes from a low to a high level. This change appears within the sensing interval and is therefore sensed by the microprocessor device, re-activating the control voltage and maintaining thereby the relay in its switched-on state.

In FIG. 3, a flow chart illustrates the progress in the microprocessor device 6 when the relay 3 is switched on. As is evident, the switch-on system uses two input signals and one output signal, that is the input signal Ref having a known phase in relation to the mains voltage, the feedback signal FB obtaining a high level when the relay contacts are closed, and the control voltage RV to the relay 3 as an output signal.

The following steps in the microprocessor device have been defined in the flow chart in FIG. 3:

301—Start of program.

301—Relay 3 switched off. Initiation of a value of the switch-off time $t_{dc}$.

303—Edge of reference voltage Ref? When "no" (N) Ref is sensed once more when "yes" (Y) proceed to step 304.

304—Calculate the moment $T_{on}$ of voltage maximum of M. Thereafter, calculate the moment $T_s$ for supplying the relay control voltage RV, using the formula $T_s = T_{on} - t_{dc}$

305—Reset to zero and start the timer function of the microprocessor device.

306—Is position $T_s$ reached by the timer? When "N" repeat sensing of timer, when "Y" proceed to step 307.

307—Switch on the relay by activating the control voltage RV.

308—Reset to zero and start timer.

309—Is the level of the feedback signal FB high? When "N" proceed to step 310, when "Y" proceed to step 312.

310—Has the moment $T_{on}$ for a voltage maximum been reached? When "N" return to step 309. When "Y" proceed to step 311.

311—The relay contacts are open, switch off relay by interrupting supply of control voltage RV, increase value of $t_{dc}$, return to step 303.

312—Read and store the timer position as the switch-on time $t_{dc}$.

313—End switch-on program.

The switch-on time which has been stored is used at the next following relay switch-on. If a longer time has elapsed or if external conditions have been changed, for example the driver voltage to the relay, a re-evaluation of the switch-on time is made by repeating the progress described above. This is made also after a mains interruption and when the memory of the microprocessor device has been erased.

In order to minimize the generation of sparks between the relay contacts the same should be opened when the current is at a minimum. When the magnetron is hot this condition will appear approximately at a zero transition of the mains voltage M, some variation of the moment may occur depending on the oven input voltage. The problem at a switch-off is that it is not possible to obtain a signal which indicates directly when the contacts are opened because the arc between the contacts will "conduct" the current. According to the invention it is possible to establish a value of the switch-off time of the relay by assuming different values and sensing the result thereof.

The relay switch-off progress has been illustrated in the graphic diagram of FIG. 4, disclosing three cases which have been denoted I, II, II. All cases have been related to the one and same mains voltage wave form M, but will evidently not appear at the same time. In the illustrated cases the respective values $t_{do1}$, $t_{do2}$, respectively $t_{do3}$ have been assumed for the switch-off time. The zero transition of the mains voltage appears at the moment $T_{off}$. The result which is sensed has been illustrated in all cases by graph RV changing from a high to low level when the relay control voltage is interrupted, the feedback signal FB being in this case disclosed by a square wave pulse of a high level when the mains voltage is positive and current conducting relay contacts, and the clarifying auxiliary signal K showing the physical position of the relay contacts and changing from a high to a low level when the relay contacts are open.

In case I the assumed switch-off time $t_{do1}$ is smaller than the real switch-off time, because the auxiliary signal K does not change until after $T_{off}$, the feedback signal FB showing however that the relay contacts in reality are conducting current during one half period of the mains voltage after $T_{off}$, since the conduction of current is continued by the arc between the relay contacts after opening of the same.

Also in case II the assumed switch-off time $t_{do2}$ is smaller than the real switch-off time, which in case I means that the conduction of current is continued by the arc between the relay contacts after the contacts have been physically opened.

In case III the auxiliary signal K shows that the relay contacts have been opened at the appearance of $T_{off}$, and at the same time the feedback signal FB will not appear. The conclusion being that the real switch-off time is smaller or equal to $t_{do3}$. By assuming switch-off time accuracy with smaller steps a desirable switch-off time accuracy be obtained.

In FIG. 5 a flow chart shows the programmed switch-off progress of the microprocessor device 6. This progress is repeated at regular intervals in order to establish a fresh value of the switch-off time because otherwise a decrease of the switch-off time will cause an increased generation of sparks in the relay without this being observed. The microprocessor device performs the following steps at a relay switch-off:

501—Start of switch-off program.

502—Level of relay voltage RV is high.

503—Has a value of the switch-off time $t_{do}$ been initiated? When "Y" proceed to step 505. When "N" proceed to step 504.

504—Initiate a value of $t_{do}$.

505—Appearing edge of reference voltage Ref? When "N" repeat sensing of reference voltage. When "Y" proceed to step 506.

506—Calculate the switch-off moment $T_{off}$, calculate the moment for interrupting the relay control voltage using the formula $T_{off}-t_{do}$.

507—Reset to zero and start timer.

508—Is position $T_{off}-t_{do}$ reached by the timer? When "N" reapeat sensing of timer. When "Y" proceed to step 509.

509—Switch off the relay.

510—Appears $T_{off}$? When "N" repeat sensing of timer. When "Y" proceed to step 511.

511—Is the level of the feedback signal FB high? When "Y" proceed to step 512. When "N" proceed to step 513.

512—Relay in switch-on state. Increase value of $t_{do}$, proceed to step 514.

513—Relay in switched-off state. Proceed to step 514.

514—Store switch-off time $t_{do}$.

515—End of program.

FIG. 6 shows a modified embodiment of the circuit diagram in FIG. 1 in which the control unit 2 of the microwave oven has been electrically isolated from the power current part of the microwave oven, that is the current supply via the mains terminals $M_A$, $M_B$, the relay 3, the high voltage transformer HVT, have been isolated from the electronic circuits including the microprocessor device 6 of the oven control system. The connection of the control unit 2 to the mains terminals illustrate nothing more than the fact that the control unit 2 has its current supply via the mains voltage, which may be obtained, for example, by means of a control voltage transformer comprised in the control unit and generating a low voltage current which is isolated from the mains.

This electrical isolation demands an optical feedback of information about the position of the relay contacts from the relay 3 to the control unit 2. This optical feedback is shown in FIG. 6 by an optocoupler, which has been represented by the transmitting light emitting diode $D_3$ and the receiving phototransistor $T_3$ of the control unit 2. The circuit diagram also shows a so called door switch included in the current supply circuit of the high voltage transformer HVT, that is in the power current part of the microwave oven.

In a microwave oven the control unit also needs a supply of information about the door status, indicating an open or a closed position of the oven door. In order to provide this information a door switch is normally used which is influenced by the oven door and being for example included in the current supply of the control unit 2.

According to the invention it is possible to eliminate the door switch for the door status information by the fact that said optocoupler $D_3$, $T_3$ may be used for the generation of information about both relay contact position and door status. This is obtained by having the transmitting light emitting diode $D_3$ connected to the node a via the resistors $R_3$ said node being connected via resistors $R_1$ and diode $D_1$ to the mains terminal $M_B$ and via resistor $R_2$, diode $D_2$ and door switch SW connected to the mains terminal $M_A$.

This means that the information which shall be transmitted via the optocoupler is on one hand if the oven door is open or closed, and the other hand if and the moment when the relay contacts of the rely 3 are closed. This may be represented by four different conditions:

0. Door switch SW open (oven door open), relay contacts
1. Door switch SW closed (oven door closed), relay contacts open.
2. Door switch SW closed (oven door closed), relay contacts closed.
3. Door switch SW open (door switch open), relay contacts closed.

Conditions 1-3 have been illustrated in the graphic diagram in FIG. 7 by the three cases I, II, III. Cases I, II have been related to the one and same mains voltage maximum M, but will evidently not appear at the same time. Case III appears at an arbitrary phase of the mains voltage M. The graphic diagram shows a signal having the high signal level DOO and the low signal level DOC, showing that the oven door is open, and respectively, closed. The signal OC represents the output signal from the optocoupler $D_3$, $T_3$. The signal K illustrates the physical position of the relay contacts of relay 3, of which a low level means open relay contacts and a high level means closed relay contacts.

Condition 0 means for example that the oven door is opened in order to put in a piece of food into the oven and that the food preparation has not yet started. The optocoupler is not conducting in this condition, and therefore the same has not been shown in the graphic diagram in FIG. 7.

The condition 1, case I, which is illustrated by that the oven door signal is changed from level DOO to level DOC. The fact that the oven door has been closed is illustrated by the signal OC, showing that the optocoupler has started conduction during negative half periods of M appearing after the moment $T_{on}$ of the voltage maximum. At the same time OC illustrates that the relay contacts are open because the optocoupler starts conducting not until a certain amount of time after $T_{on}$.

Condition 2, case II, means that food preparation has just started. This is shown by the fact that the signal K changes from low to high level, indicating that the relay contacts are closed, but the signal level DOC showing that the oven door is closed.

These two conditions are shown by the signal OC by the fact that the optocoupler starts conducting when $T_{on}$ occurs and is continuously conducting thereafter. This change of OC is established by the fact that the opto-coupler starts conducting during positive half periods of M via $D_2$, $R_2$, directly after closing of the relay contacts.

Condition 3, case III in FIG. 7, means that the food preparation is interrupted by opening of the oven door. This means that the door switch SW is opened and consequently that the optocoupler stops conducting. That the oven door is opened is shown by the fact that the door signal changes level from DOC to DOO, which is also shown by the signal OC by the fact that the optocoupler stops conducting immediately when the door switch is opened.

As is apparent from the foregoing specification, the relay control described a may be useful also in applications other than microwave ovens, in which it is desirable to eliminate the influence by switch-on and switch-off time variations of relays comprised therein. It should be understood that I wish to embody within the scope of the patent warranted hereon, all such modifications as reasonably and properly come within the scope of our contribution to the Art.

What is claimed is:

1. A microwave oven comprising a microwave source and a power unit including a high voltage transformer for supplying a high voltage to the microwave source, said high voltage transformer being supplied with a mains voltage via a switch device and a control unit in order to connect the mains voltage, when starting the oven, at a moment substantially coinciding with a mains voltage maximum, said switch device comprising a relay being supplied at switch-on with a control voltage from said control unit and the relay contacts of which are closed at switch-on with a delay corresponding to the switch-on time of the relay, feedback means operatively connected to said switch device, said feedback means supplying a feed back signal to the control unit indicating changing states when the relay contacts change from an open to a closed position, a reference signal indicating the mains voltage phase also being supplied to the control unit, said control unit operatively connected to said switch device and said feedback means and comprising a microprocessor device being programmed to perform the following steps during switch-on of the relay;

assume a value $t_{dc}$ for the relay switch-on time calculate the moment $T_{on}$ of a mains voltage maximum from said reference signal switch on the relay by supplying the control voltage at the moment $T_{on}-T_{dc}$ sense the feedback signal within a interval around $T_{on}$ when the relay contacts are closed within said interval, maintain the relay switched on alternatively, when the relay contacts are open within said interval, perform relay switch-off by interrupting the control voltage supply, assume a new value of $t_{dc}$ and repeating the programmed steps until the relay contacts are closed within the interval.

2. A microwave oven as claimed in claim 1, in which the relay has a switch-off time resulting in a corresponding delay when the contacts are opened during a stop of the oven, wherein said microprocessor device is programmed to perform the following steps at a relay switch off;

assume a value $t_{do}$ for the switch-off time calculate $T_{off}$ of a zero transition of the mains voltage switch off the relay by interrupting the supply of control voltage at the moment $T_{off}-T_{do}$ sensing the feedback signal within an interval around $T_{off}$ when the relay contacts are opened within the interval, maintain the switch-off time alternatively, when the relay contacts are not opened within the interval, assume a new value $t_{do}$ repeating the programmed steps during future switch-offs until the relay contacts are opened within the interval.

3. A microwave oven as claimed in claim 1, wherein said control unit comprises a timer for measuring the established switch-on time respectively switch-off time, and a memory for storing and assigning the time values at future relay switch-ons and relay switch-offs, said timer and said memory being preferably implemented by microprocessor device.

4. A microwave oven as claimed in claim 1, further comprising an oven control system having a microprocessor, wherein said control unit is implemented by said oven control system, and in which the microprocessor of the oven control system is used for said microprocessor device for controlling the relay of the switch device.

5. A microwave oven as claimed in claim 1 in which the control system of the oven is electrically isolated from the power current part of the oven, including said high voltage transformer connected to the mains, a door switch which is operably by the oven door of the microwave oven being arranged so as to interrupt respectively close the mains voltage when said door is opened respectively closed, feedback means being arranged to supply a door status information indicating an open or closed state of the door, wherein said feedback means comprising an optocoupler arranged to obtain a conductive state during one-half period of the mains voltage when the relay contacts are open and the oven door is closed, and to change into a conductive state during the second half period of the mains voltage when the relay contact and the oven door are closed, and to obtain a non-conductive state when the oven door is opened, the feedback signal from the optocoupler supplying thereby information about both relay contact position and door status.

6. A microwave oven as claimed in claim 5, in which said opto-coupler is in a conductive state during the negative half period of the mains voltage when the relay contacts are open, mains voltage being supplied to said power unit via first and second mains terminals, that said optocoupler comprising a light emitting diode the anode of which is connected to said first mains terminal via the relay contacts and the cathode of which is connected via a resistor to a circuit node, being connected in first hand to said mains terminal via the series connection of a first forwardly directed diode and a first resistor, and in second hand to said second mains terminal via the series connection of a second forwardly directed diode, a second resistor and said door switch.

* * * * *